United States Patent [19]

Walter et al.

[11] Patent Number: 4,562,097

[45] Date of Patent: Dec. 31, 1985

[54] PROCESS OF TREATING FABRICS WITH FOAM

[75] Inventors: Andrew T. Walter; George M. Bryant, both of Charleston, W. Va.; Ronald L. Readshaw, Bridgewater, N.J.

[73] Assignee: Union Carbide Corporation, Danbury, Conn.

[21] Appl. No.: 556,573

[22] Filed: Nov. 30, 1983

Related U.S. Application Data

[63] Continuation-in-part of Ser. No. 148,226, May 9, 1980, abandoned, which is a continuation-in-part of Ser. No. 883,241, Mar. 3, 1978, abandoned, which is a continuation-in-part of Ser. No. 670,528, Mar. 25, 1976, abandoned.

[51] Int. Cl.[4] ..... B05D 1/26

[52] U.S. Cl. ..... 427/209; 427/210; 427/244; 427/288; 8/477

[58] Field of Search ..... 118/415, 417, 412, 410; 427/358, 373, 244, 350, 209, 288, 210; 156/78; 8/477

[56] References Cited

U.S. PATENT DOCUMENTS

| | | | |
|---|---|---|---|
| 1,948,568 | 2/1934 | Faber et al. | 8/19 |
| 2,766,717 | 10/1956 | Neidich et al. | 118/415 X |
| 2,971,458 | 2/1961 | Kumons et al. | 101/170 |
| 3,326,181 | 6/1967 | Killeen | 118/411 |
| 3,448,462 | 6/1969 | Thomas | 427/289 X |
| 3,697,314 | 10/1972 | Stritzko | 8/19 X |
| 3,762,860 | 10/1973 | Abrahams et al. | 8/21 A |
| 3,849,173 | 11/1974 | Drelich et al. | 427/288 X |
| 3,865,078 | 2/1975 | DeHowitt et al. | 118/411 X |
| 3,941,902 | 3/1976 | Wennerblom | 118/410 X |
| 3,969,780 | 6/1976 | Henderson | 118/415 X |

FOREIGN PATENT DOCUMENTS

| | | |
|---|---|---|
| 2416259 | 10/1975 | Fed. Rep. of Germany |
| 73/1880 | 12/1973 | South Africa . |
| 1371781 | 10/1974 | United Kingdom . |
| 1406665 | 9/1975 | United Kingdom . |

OTHER PUBLICATIONS

Bryant, G. M., "Energy and Related Savings From Controlled Low Wet Pick-Up Application Of Textile Chemicals And Dyes Via Semistable Foams", American Chemical Society Symposium Series No. 107, 1979, pp. 145–154.

Baker, K. L., et al., "Foam Finishing Technology", Textile Research Journal, vol. 52, No. 6, Jun. 1982, pp. 395–403.

Bryant, G. M., "Dynamic Sorption Of Semistable Foams By Fabrics", Textile Research Journal, vol. 54, No. 4, Apr. 1984, pp. 217–226.

*Primary Examiner*—Evan K. Lawrence

*Attorney, Agent, or Firm*—Francis M. Fazio

[57] ABSTRACT

A continuous process for the application of a textile treating composition in the form of a froth or foam to a substrate such as textiles. The process enables the application in a uniform manner of any foamable functional composition that can be used in the treatment of a textile fabric to improve its properties. In the process of foamed functional treating composition is continuously conveyed to the applicator nozzle, the substrate is continuously passed across and in contact with the applicator nozzle so as to simultaneously contact said substrate with the foamed composition and the applicator nozzle at a rate such that a predetermined controlled amount of the foamed functional treating composition is uniformly applied to the surface of the substrate and the foam immediately breaks on contact with the substrate and is readily absorbed. The process of this invention generally leaves the textile material essentially dry to the touch and thus requires less energy consumption in drying and further treatment of the textile.

6 Claims, 3 Drawing Figures

PROCESS OF TREATING FABRICS WITH FOAM

This application is a continuation-in-part of application Ser. No. 148,226, filed on May 9, 1980, abandoned, which in turn is a continuation-in-part of application Ser. No. 883,241 filed on Mar. 3, 1978, abandoned, which in turn is a continuation-in-part of application Ser. No. 670,528 filed on Mar. 25, 1976, abandoned.

BACKGROUND OF THE INVENTION

The treatment of textile materials with various chemicals, dyestuffs, resins and the like has been long carried out using aqueous baths in these processes. In such processes the fabric is essentially saturated by immersion in a water bath containing the treating chemical and eventually the water must be removed in order to continue the processing or to dry the fabric. Of the many procedures employed in the past for the treatment of fabrics, the most commonly employed is the pad-dry process in which the fabric is immersed and saturated with the aqueous treating solution, squeezed between rollers to a given wet pick-up and subsequently dried or dried and cured on a frame or heated drying roll before being taken up in a roll once again. The amount of water retained by the fabric is normally controlled by the pressure of the squeeze roll; in conventional methods a lower limit of about 50 to 70 percent water based on the weight of the fabric is still retained, depending upon the particular fabric used. This large amount of water requires a tremendous amount of energy in the form of heat to dry the fabric. It has been estimated that the amount of energy required to remove the water and dry the fabric is many times greater than the amount of energy that is needed in heating the cloth to carry out the desired chemical treating step, as for example, in the application and cure of a wash and wear finish on the fabric, or in the continuous dyeing of a fabric. In addition to the pad-dry process, in which the water is removed by squeezing between rollers, other procedures have recently been developed for more efficient removal of water. In one such procedure the saturated fabric is conveyed to a jet squeezer which employs a stream of compressed air jetting outward at the point of contact between the fabric and the nip rolls to substantially reduce the moisture content of the fabric. The use of this technique has resulted in a decrease of the water content in the fabric to about half of that normally remaining when using the squeeze roll technique discussed above. In another procedure vacuum extractor rolls are used. This process entails conveying the wet fabric as it exits from the treating bath over a perforated roll within which a vacuum is created whereby the moisture is extracted from the fabric. In some instances, roller coating methods can be used with continuously deliver aqueous treating composition to the fabric, with the add-on governed by the fabric speed and the rate of delivery of the treating composition by the coating roller. In this procedure the treating composition generally remains predominately on or near the surface of the fabric, particularly when low add-ons are involved.

Within the past few years, several new approaches have been taken to obtain uniform application of compositions to porous substrates. These recently developed procedures use foams in different form. However, the methods by which the foams had been applied to treat the fabric or yarn leave much to be desired. One such disclosure is to be found in U.S. Pat. No. 3,697,314, issued Oct. 10, 1972. In this patent there is shown a method for producing foam and then passing a yarn through the foam so as to coat the exterior surface of the yarn with the foamed treating agent. It stresses that the yarn must pass through the foam agglomeration in order to assure a uniform distribution of the agent over the entire circumferential surface of the yarn as it passes through the foam and shows no means by which the foam could be applied on only one surface of a fabric or material and still obtain uniform distribution or uniform penetration of the interior of the yarn or fabric. An earlier attempt to use foam for the treatment of textile materials is to be found in U.S. Pat. No. 1,948,568, issued Feb. 27, 1934. In this disclosure, a textile material is suspended in a closed container and foam is pumped into the container and forced through the textile material until the textile material is uniformly impregnated from all sides throughout the substrate structure and saturated with the textile treating agent in the form of a foam. In the batch process disclosed in this patent, the textile material is in a stationary or fixed position.

Though a few disclosures do exist on the use of foam for the treatment of textile materials, essentially all of the industry still uses aqueous treating baths and processes in which the fabrics are generally immersed in the liquid bath for the application of the treating material or the liquid itself is applied by means of a kiss roll to the textile. As previously indicated, this entails the use of a large amount of energy to subsequently remove the water from the fabric.

SUMMARY OF THE INVENTION

This invention relates to a method for treating porous substrate such as a fabric or textile material or paper product by the application thereto of a textile treating composition in foam form. The invention comprises the steps of foaming a metered quantity of the textile treating composition to produce a foam having a specified foam density and bubble size and a specified froth stability half-life, continuously conveying the foamed textile treating composition to an applicator nozzle and continuously passing a substantially dry textile material to be treated across the applicator nozzle so as to simultaneously contact the dry textile material with the foamed textile treating composition and the applicator nozzle. In this manner, a predetermined and controlled amount of the foamed textile treating composition is absorbed by the textile material at the applicator nozzle; the amount being an amount that generally leaves the surface of the textile material essentially dry to the touch. Subsequently the textile material is recovered and further treated if necessary. The process can also be employed with a textile that has not been dried before the foamed textile treating composition is applied to its surface. In this manner, drying after conventional fabric preparation steps prior to chemical treatment can be avoided.

DESCRIPTION OF THE INVENTION

Figure 1:
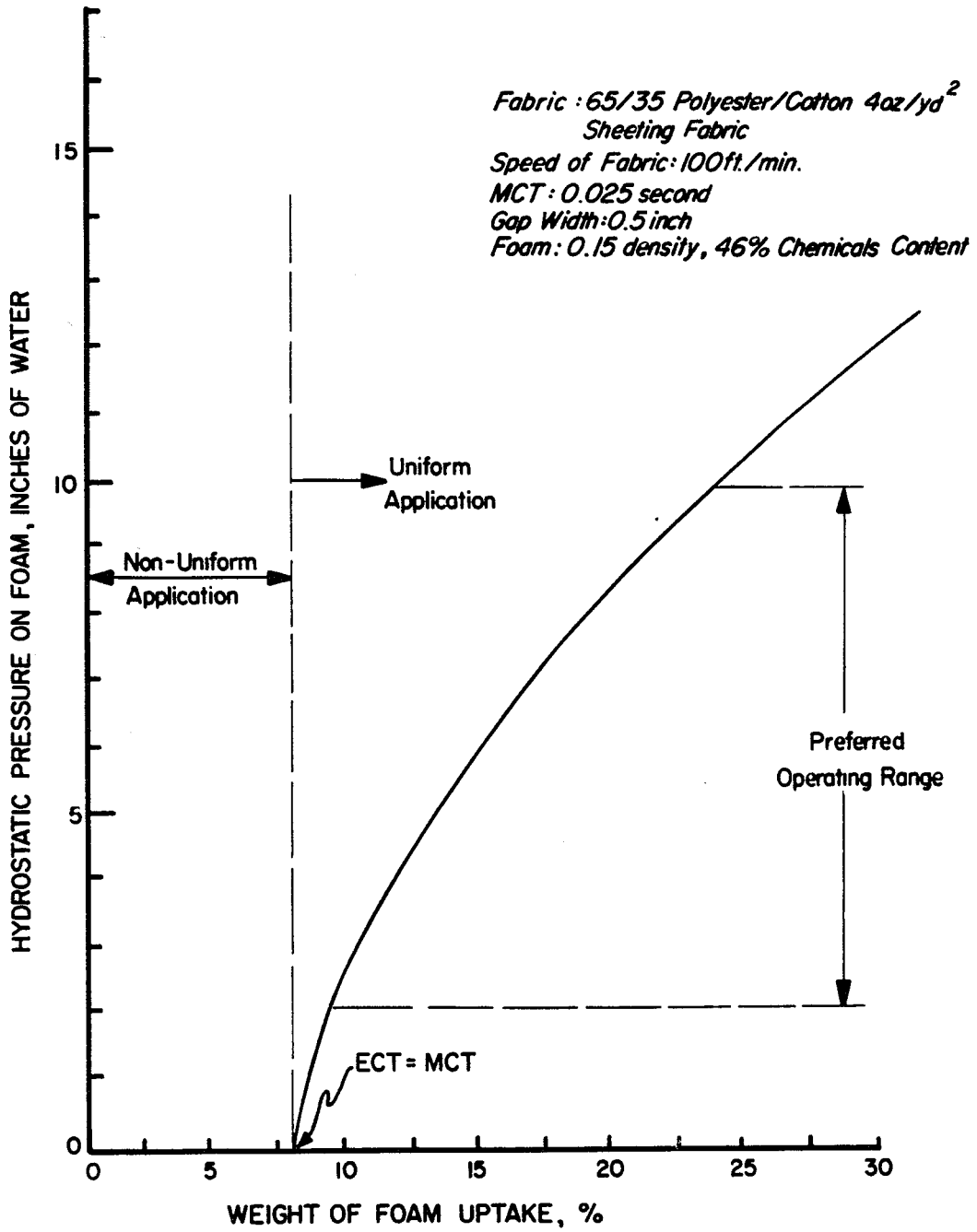
FIG. 1 illustrates the typical relationship that exists between foam uptake by the substrate and the hydrostatic pressure on the foam in graphical form.

The process of this invention can be used to treat any porous substrate such as a textile fabric or a non-woven material, paper, or wood veneer, with any of the functional chemicals that are normally used in their treatment. Thus, it can be used to apply a flame retarding composition, a waterproofing or water repellant composition, a latex, a fabric softener, a lubricant, a hand builder, a dye or pigment for coloring the fabric, a sizing agent, a whitening agent or fluorescent brightener, a bleach, a binder for a nonwoven fabric, a scouring agent, a radiation curable or polymerizable monomer or polymer or oligomer, or any other material that is normally used or applied to a fabric or similar substrate. As previously indicated, the process of this invention permits one to apply the functional or treating chemical to the surface of the material without employing unnecessarily large quantities of water. In view of the escalating energy costs and short supplies of natural gas and other fuels this is a distinct advantage since less energy is required in the further and subsequent treatment of the treated substrate.

In the process of this invention a functional treating formulation or composition containing the functional reagent that is to be added to the fabric is foamed in a foaming apparatus. The term functional treating composition or variants thereof is used in this application to define a formulated composition containing a reactive or functional reagent that is used to treat a porous substrate such as a fabric or paper to impart a desired physical or chemical property thereto. These functional treating compositions are used to produce the foams applied to the substrate by the process of this invention and contain the foaming agent, functional chemical, wetting agent, water and other additives as identified and in the concentrations hereinafter set forth. The equipment used for producing a foam is well known and many different types are commercially available. The composition, in the form of a foam, is then conveyed to a foam applicator nozzle where the foam is transferred to the surface of the textile material that is to be treated. The manner in which the foam is transferred to the textile material is critical for uniform distribution on to the fabric. It has been found that the manner in which the transfer is made, the specific density and bubble size, and the stability of the foam are important. When this process is properly carried out, one obtains a fabric which has been treated uniformly and which is generally essentially dry to the touch. Many other advantages exist over the conventional prior methods in which the fabric is completely immersed in the treating solution or the liquid is applied by means of rolls. For example, in the instant process the low water pick-up results in lower energy consumption in drying, reduced water comsumption and water pollution, absence of migration of the functional chemicals deposited on the fabric during the drying operation, the ability to treat one side of the fabric without affecting the other side of the fabric if desired, more efficient utilization of the functional chemicals, sequential addition of various functional chemicals without an intermediate drying step, as well as many other advantages which will become apparent hereinafter.

The foam is usually generated in commercially available foam generating devices, which generally consist of a mechanical agitator capable of mixing metered quantities of a gas such as air and a liquid chemical composition containing the functional treating agent or chemical that is to be applied to the fabric and converting the mixture to a foam. It has been found that the density of the foam, its average bubble size and the stability of the foam are important factors for the proper operation of this invention. The foam density can range from 0.005 to 0.03 gram per cc, preferably from 0.01 to 0.2 gram per cc. However, when paper is the substrate to be treated foam density can be as high as 0.6 gram per cc.

The foams generally have an average bubble size of from about 0.05 to 0.50 millimeters in diameter and preferably from 0.08 to 0.45 millimeters in diameter. The foam half-life is from one to sixty minutes, preferably from three to forty minutes.

The foam density and foam half-life are determined by placing a specified volume of the foam in a laboratory graduated cylinder of known weight, a 100 cc or 1,000 cc cylinder can be used, determining the weight of the foam in the cylinder, and calculating the density from the known volume and weight of the foam in the cylinder.

From the measured foam density and volume, and the known density of the precursor liquor, the liquor volume which would equal one-half of the total weight of the foam in the cylinder is calculated. The half-life is the time for this volume of liquid to collect in the bottom of the cylinder.

The foam bubble size is measured on a sample of foam taken at the applicator nozzle and is determined by coating the underside of a microscope glass slide with the foam, placing the slide on the microscope, supporting the slide at each end by two slides, and photographing it at once, preferably within 10 seconds, with a Polaroid ® camera at a magnification of 32 fold. In an area of the photomicrograph measuring 73 by 95 mm, corresponding to an actual slide area of 6.77 square millimeters, the number of bubbles is counted. The average bubble diameter size in mm. is then determined by the equation:

$$\text{Average Bubble Size} = \frac{2}{\sqrt{\pi}}\left[\frac{(6.77)(\text{Liquid Density} - \text{Foam Density})}{\text{No. of Bubbles}}\right]^{\frac{1}{2}}$$

The compositions used for producing the foam contain a frothing or foaming agent at a concentration of about 0.2 to 5 weight percent, preferably from 0.4 to 2 weight percent; the functional chemical at a concentration of from about 5 to 75 weight percent, preferably from 10 to 60 weight percent, this being dependent upon the particular functional chemical being employed; with water making up the balance of the weight of the total composition. There can also be present, as an optional ingredient, a wetting agent at a concentration of from about 0.001 to 5 weight percent or more, preferably from about 0.01 to 1.0 weight percent of the total composition when the wetting agent is used. However, it need not always be present and can in some instances be completely absent when the foaming agent supplies sufficient wetting action.

As frothing agent, one can use any surface active agent which will produce a foam having the characteristics herein before described. The composition is foamed in a conventional foaming apparatus to produce a foam using air or any inert gaseous material. The amount of inert gas that is used to foam the composition is generally about 5 times the volume of the liquid composition that is to be foamed and can be as much as 200 times or more thereof. In this manner there is produced a foam having the desired density and bubble size. The particular components used to produce the foam are important in order to achieve a foam which will be readily absorbed in a uniform manner by the substrate material and permit the application of the desired amount of the functional chemical.

Illustrative of suitable foaming agents, one can mention the ethylene oxide adducts of the mixed $C_{11}$ to $C_{15}$ linear secondary alcohols which contain from about 10 to 50 ethyleneoxy units, preferably from about 12 to 20 ethyleneoxy units in the molecule. One can also use the ethylene oxide adducts of the linear primary alcohols having from 10 to 16 carbon atoms in the alcohol moiety, or of the alkyl phenols wherein the alkyl group has from 8 to 12 carbon atoms, wherein the adducts can have from about 5 to about 50, preferably from about 7 to 20 ethyleneoxy units in the molecule. Also useful are the fatty acid alkanolamides such as coconut fatty acid monoethanolamide. Another suitable class of frothing agents is the sulfosuccinate ester salts such as disodium N-octadecylsulfosuccinate, tetrasodium N-(1,2-dicarboxyethyl)-N-octadecylsulfosuccinate, diamyl ester of sodium sulfosuccinic acid, dihexyl ester of sodium sulfosuccinic acid, dioctyl ester of sodium sulfosuccinic acid, and the like. In addition to the above nonionic and anionic surfactants one can also use a cationic surfactant or an amphoteric surfactant such as distearyl pyridinium chloride, N-coco-beta-aminopropionic acid (the N-tallow or N-lauryl derivatives) or the sodium salts thereof, stearyl dimethyl benzyl ammonium chloride, the betaines or tertiary alkylamines quarternized with benzene sulfonic acid. These are well known and any such material can be used in addition to those specifically identified above. Blends of one or more surfactants are often used to advantage. In selecting the foaming agent for a particular formulation, care must be exercised to use those which will not unduly react with the other reactants present or interfere with the foaming or treating process.

As previously indicated a wetting agent can also be optionally present when its presence is needed to produce a foam of the desired fast breaking and wetting properties with sufficient stability to be pumped from the foam generator to the applicator nozzle. The foams are semi-stable and fast wetting and are produced from compositions containing the defined components in relatively high concentration when compared to aqueous treating compositions heretofore used. The stability of the foam produced with these compositions must allow pumping of the foam from the foam generator to the applicator head, but the foam must be readily broken and rapidly absorbed when it reaches the substrate surface. The foam breakdown characteristic is important, since retention of the foam or bubble structure on the treated substrate surface can result in craters, spotting, or otherwise uneven distribution on the substrate. In addition, foam breakdown characteristics are important to facilitate recycle; any of the known physical techniques, i.e. elevated temperature, can be used in the recycle step. In regard to foam breakdown, the foams having the half-life defined have been found to possess the desired combination of stability to facilitate pumping and delivery to the substrate, and instability to facilitate fast wetting when contacted with the substrate and ease of recycle.

The presence of the optional wetting agent is important when the foaming agent used produces a semi-stable foam but is a relatively poor wetting agent with the consequence that the foam does not provide sufficient front to back uniformity for continuous high speed application to the substrate. In such instances a combination of foaming agent and wetting agent is used and illustrative of suitable wetting agents one can mention the adduct of 6 moles of ethylene oxide with trimethyl nonanol, the adducts of about 7 or 9 moles of ethylene oxide with the mixed $C_{11}$ to $C_{15}$ linear secondary alcohols or with the $C_{10}$ to $C_{16}$ primary alcohols, the adduct of 9 moles of ethylene oxide with nonylphenol; the silicone wetting agents of the structure

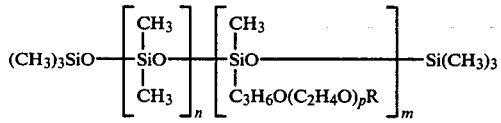

wherein n has a value of 5 to 25, m has a value of 3 to 10, p has a value of 6 to 20 and R is alkyl of 1 to 6 carbon atoms; also useful are the commercially available fluorocarbon wetting agents such as the known perfluoroalkylated surfactants.

The amount of such wetting agent to be added to provide for the fast breaking and rapid absorption properties will vary depending upon the particular wetting agent selected and this amount can be readily ascertained by a preliminary small scale evaluation. Thus, it was observed that the concentration of the fluorocarbon wetting agents is preferably in the range of from 0.001 to 0.5 weight percent, and the range for the silicone wetting agents is preferably from 0.01 to 0.3 weight percent. It has also been observed that excessive quantities of the silicone or fluorocarbon wetting agents may inhibit foam formation or shorten foam stability to such an extent that pumping and delivery of foam to the substrate is no longer feasible. Thus, the preliminary small scale screening test will establish if such a problem exists in any particular instance. As previously indicated, some foaming agents possess sufficient wetting properties that there is no need for the use of the supplementary or optional wetting agents. However, in most instances, better front to back uniformity of treatment is obtained using a mixture or combination of foaming agent and wetting agent. It has also been observed that the addition of a known foam stabilizer, such as hydroxyethyl cellulose, hydrolyzed guar gum, can be of benefit, provided it does not unduly affect the desired foam properties.

The process of this invention can be used to apply any number of functional or treating chemicals to a substrate to impart a particular property or treatment thereto. Thus, the process can be used to apply flame-retarding reagents, waterproofing or water-repellant reagents, mildew proofing reagents, bacteriostats, permanent press or wash and wear compositions, softeners, lubricants, hand builders, dyes, pigments, sizes, whitening agents, fluorescent brighteners, bleaches, binders for non-woven fabrics, latexes, scouring agents, thermal or radiation curable monomers or oligomers or polymers, soil or stain release agents, or any other material known to be used in the treatment of textiles or papers. An important requirement of the selected functional or treating chemical is that it not interfere with the foam generation, nor with the foam properties to the extent that the foamed composition could not be properly conveyed to the applicator nozzle or that the foam could not be properly applied to the substrate in a manner and form that it would rapidly break and penetrate the substrate in a uniform manner. The process is not limited to any particular functional or treating agent or combination of agents. Illustrative of typical functional chemicals one can mention dimethyloldihydroxyethylene urea, dimethylolethylene urea, dimethylolpropylene urea, urea formaldehyde resins, dimethylol urons, the methylolated melamines, methylolated triazones; the methylolated carbamates such as the ethyl or methoxyethyl or isopropyl or butyl carbamates; the epoxides such as vinyl cyclohexene dioxide, 2,3-diallyoxy-1,4-dioxane, 2,3-bis(2,3-epoxypropoxy)-1,4-dioxane, the diglycidyl ether of bisphenol-A, bis(3,4-epoxybutyl)ether; flame-proofing agents such as tetrakis hydroxymethyl phosphonium chloride, polyvinyl chloride latexes, (N-hydroxymethyl-3-dimethyl phosphono)propionamide; water-proofing or water repellant agents such as aluminum formate, sodium formoacetate, methylene bis-stearamide; mildew proofing and bacteriostat agents such as copper-8-quinolinolate, dihydroxydichlorodiphenylmethane, zinc salts of dimethyldithiocarbamic acid, dihydroxymethyl undecylenamide; latexes such as polyvinyl acetate latexes, acrylic latexes, styrene-butadiene latexes; softeners such as emulsifiable polyethylene, dimethyl ammonium stearate salts; lubricants such as butyl stearate, diethylene glycol stearate, polyethylene glycol, polypropylene glycol; hand builders such as polyvinylacetate latexes, acrylic latexes, styrene-butadiene latexes; dyes and pigments such as Acid Blue 25 (Color Index 62055), Acid Red 151 (Color Index 26900), Direct Red 39 (Color Index 23630), Dispersed Red 4 (Color Index 60755), Phthalocyanine Blue 15 (Color Index 74160); sizes such as polyvinyl alcohol, corn starch; whitening agents such as 4-methyl-7-dethylaminocoumarine; bleaches such as sodium hypochlorite, chlorine, hydrogen peroxide, dichlorodimethyl hydantoin sodium perborate; binders for non-woven fabrics such as ethylene-vinyl acetate emulsion polymer, acrylic emulsion polymer, vinyl-acrylic copolymer; scouring agents such as sodium lauryl sulfate, triethanolamine lauryl sulfate, sodium N-methyl-N-oleoyltaurate, primary and secondary alcohol ethoxylates radiation curable monomers and oligomers such as 2-hydroxyethyl acrylate, neopentyl glycol diacrylate, pentaerythritol triacrylate, isodecyl acrylate, acrylated epoxidized soybean or linseed oil; antistatic agents such as ethoxylated stearyl amines; soil or stain release agents such as acrylic polymers, fluorocarbon emulsions.

The compositions used in the process of this invention are prepared by mixing the selected functional chemical, foaming agent, wetting agent and water, with other conventional agents normally present, in the amounts indicated. This formulation has a Brookfield viscosity of from 0.5 to 75 cps, preferably from 1 to 50 cps at 25° C. The manner of preparing the formulation will depend upon the particular functional or treating agent present and the procedures normally used for preparing compositions containing the selected functional agent are normally employed in producing our formulations. The formulation is then foamed, the foam is conveyed to a foam applicator device or nozzle and there it is applied to the surface of the substrate.

In producing the foam, a metered quantity of the formulation is introduced to the foamer and foamed. The foaming step is controlled by adjusting the volume of air introduced to the foamer and the rotation rate, in rpm, of the rotor in the foamer. The rotor's rotating rate plays an important role in producing a foam that will have the previously defined bubble size and half-life. The relative rates of feed of the formulation and the gas will determine the density of the foam.

The nozzle used to apply the foam to the substrate and the manner in which the substrate contacts the nozzle play important roles in the successful operation of this process. The applicator nozzle is designed so that it has sufficient side-to-side width that foam can be applied across the width of the fabric. The gap or width between the forward and back lips of the nozzle orifice will vary from 10 mils to about six inches or more, preferably from 20 mils to 4 inches. The width or gap of the nozzle orifice is of a dimension such that the machine contact time is equal to or less than the equilibrium contact time for the particular foam-substrate combination that is being run, as defined by the equation $MCT \leqq ECT$.

The machine contact time, abbreviated MCT, is the amount of time that any given point of the substrate remains over the nozzle orifice during the foam treatment. The machine contact time in seconds is equal to the gap or orifice width in inches divided by the speed of the fabric in inches per second. This statement when presented in equation form appears thusly:

$$MCT \text{ (in seconds)} = \frac{\text{Gap width (in inches)}}{\text{Fabric speed (inches/second)}}$$

The equilibrium contact time, abbreviated ECT, is the time in seconds required for the substrate moving at a selected speed to uniformly absorb the foam at atmospheric pressure at the rate the foam is being delivered to the applicator nozzle. The ECT value is a measured characteristic property of the foam/fabric system, it is not and cannot be calculated, it is a measured value for each specific operative system. It is the measured time value required for a particular foam/fabric system in which the fabric is moving at a selected speed for the fabric to uniformly absorb the foam at the rate the foam is being delivered to the applicator nozzle.

At atmospheric pressure when the foam is being uniformly absorbed by the fabric at the same rate it is being introduced, then ECT=MCT. This is the abscissa intersect point in FIGS. 1, 2 and 3; it is a measured value. Additional foam will be absorbed by the substrate when the foam is under pressure since more foam is being pumped to the substrate. Preferably, a slight uniform pressure of 2 to 20 inches of water is maintained to control uniformity of application.

At pressures greater than atmospheric pressure, all other variables being held constant, the ECT (which is always experimentally measured at atmospheric pressure for each specific system) is greater than MCT for all values on the curves of the figures. At all these values on the curve, as shown in FIG. 1, the foam is being delivered at a rate greater than it would be absorbed at atmospheric pressure, but uniform application is still obtained. Under this condition more foam is being absorbed than the minimum amount that would be required to obtain uniform application. This is not objectionable and is, in fact, desirable, as shown by the "Preferred Operating Range" designation in FIG. 1, at the "Preferred Operating Range" one minimizes the non-uniformity of foam pick-up that may be caused by variation in the fabric structure or the absorption properties of the fabric. It has been observed that when MCT is greater than ECT that non-uniform application results. In other words, when the absorption rate is greater than the delivery rate of the foam, uniform application is no longer achieved.

In some instances it may be desired to have MCT greater than ECT. It has been observed that in such instances one may obtain an uneven stripe or random pattern across the width of the substrate, that is, non-uniform application. This is of interest, for example, when even or uniform dyeing is not desired.

When foam is delivered to the applicator at a given rate of feed $R_f$(g/min) is used and a given substrate or fabric feed rate $R_s$(g'/min), then this combination of $R_f$ and $R_s$ at the application gives a fixed add-on rate of foam to fabric which can be expressed as the percent by weight of foam applied to the fabric (% wfu$=R_f/R_s\times 100$); % wfu is the same as the "Weight Of Foam Uptake" which is plotted as the abscissa in FIG. 1.

As $R_f$ to the applicator varies, % wfu varies.

For any given $R_f$ or % wfu, a given amount of time is required for that amount of foam to be absorbed by the fabric. This is for a given specific fabric, fabric absorbency, foam composition, etc. When these are constant, as % wfu is increased, the time required for absorption by the fabric is increased, and vice-versa.

Consider what happens in an experiment in which we vary the % wfu of foam onto a given fabric with fabric speed, nozzle gap width, foam composition etc., all maintained at preselected constant values. (note that MCT is held constant). For very low % wfu, the absorption capacity and $R_f$ for that foam will be such that the fabric will absorb the foam in a time interval shorter than the MCT. In fact the absorption will be so fast as to create a "starved feed" a condition in the applicator and the application will be "spotty". In a "starved feed" situation there is insufficient foam being added for uniform application or, as stated above, the absorption rate is greater than the delivery rate of the foam. As the $R_f$ to the applicator is increased, i.e. for higher % wfu, the fabric will at first continue to absorb and take away the foam inside the fabric structure; when using the types of foams disclosed the foam is broken. However, the absorption capacity of the fabric and its rate of absorption have a limit, and when this limit is reached, more foam cannot be absorbed in the time available over the applicator opening, or MCT, at atmospheric pressure. If we attempted to achieve more % wfu at atmospheric pressure, free foam would accumulate at the point of application; if the applicator were not closed, foam would "ooze out" or a large foam bank would grow at that point.

At the "balance point" at atmospheric pressure, where the rate of foam delivery is equal to the maximum rate of foam pick-up by the fabric, we define the foam/fabric contact time as the "Equilibrium Contact Time" or ECT and this is a measured quantity as previously indicated.

The ECT value is a measured characteristic property of the foam/fabric operative system, it cannot be calculated, it is a measured value for each operative system. It is the measured time value required for a particular foam/fabric system moving at a selected speed to uniformly absorb the foam at the rate it is being delivered to the applicator nozzle at atmospheric pressure. This measurement is made by the individual operating the system. At atmospheric pressure when the foam is being uniformly absorbed by the fabric at the same rate the foam is being introduced then ECT equals MCT. This is shown as the intersect point in the drawings and it is a measured value measured by the operator. At foam feed rates greater than that at the "balance point", the pressure within the applicator becomes greater than atmospheric pressure, all other variables being held constant, the ECT value measured as indicated above is greater than MCT for all values on the curve. At these other points on the curves of the drawings the foam is being delivered at a rate greater than it would be absorbed at atmospheric pressure, but uniform application is still obtained since adequate foam is being used. As previously indicated, under this condition more foam is being absorbed than the minimum amount that would be required to obtain uniform application. At the intersect the amount of foam being absorbed is the minimum required to obtain uniform application and as indicated the absorption of more than the minimum amount of foam is not objectionable but is, in fact, desirable, as shown by the designation "Preferred Operating Range" in FIG. 1, so as to assure any variation in the fabric structure that might be a cause of variation in the absorption properties of the fabric will not lead to non-uniform application. Since the intersect point at which ECT=MCT indicates that point at which the minimum amount of foam needed to obtain uniform application is reached, at points to the right of this intersect one is introducing an amount of foam greater than the minimum amount required for uniform application and at points to the left of this intersect one is introducing an amount of foam less than the minimum amount required for uniform application.

One of the means for increasing the amount of foam uptake is by increasing the flow of foam to the applicator. Since a greater amount of foam is then being contacted with the substrate, at atmospheric pressure more time is required for the substrate to absorb the foam. The time for foam and fabric to reach equilibrium at atmospheric pressure is greater than the time the fabric is in contact with the applicator nozzle and hence MCT<ECT. Increasing the amount of foam added increases the time to reach equilibrium since more foam must be absorbed by the substrate. As shown in the drawings ECT=MCT at the intersect point of the abscissa. This is the point defining the minimum amount of foam required for uniform application. In FIG. 1 the minimum value of Weight Of Foam Uptake is 8%. Any quantity of foam uptake above this 8% value would continue to give uniform application for the defined system shown but the relationship of ECT and MCT are then no longer MCT=ECT on the curve; this relationship will be MCT≦ECT. At foam uptake below the 8% value in this defined system non-uniform application results and again the relationship of ECT and MCT are no longer MCT=ECT on the curve; in this instance the relationship will be MCT>ECT. Thus, it becomes apparent that to achieve uniform application MCT≦ECT.

ECT is measured for a particular operative system by using a fixed treating system having a fixed foam density, a fixed fabric, a fixed fabric speed across the gap, and a fixed gap width. As foam is supplied to the applicator head and delivered to the fabric the operator reads the pressure drop across the fabric from a manometer connected to the application chamber. He increases the amount of foam supplied until pressure develops in the applicator head; while increasing the amount of foam he adjusts the liquor and air feeds to maintain foam density at the selected constant value. This is repeated and measurements of hydrostatic pressure and weight of foam uptake are made at several points and they are plotted to produce a curve, as shown in the drawings. Thus, in obtaining the values needed for the figures, the hydrostatic pressure was varied by bringing more foam into contact with the fabric substrate. The plotted points are then extrapolated back to zero or atmospheric hydrostatic pressure and at this intersect ECT equals MCT while at the other points along the curve ECT is greater than MCT. The uniformity of application is determined by the operator's use of a positive hydrostatic pressure.

For % wfu greater than the maximum spontaneous % wfu at atmospheric pressure, a closed applicator will develop a pressure within the applicator head. This "driving pressure" allows more foam to be driven into the fabric and absorbed without the foam accumulation that would otherwise occur. Since we have defined ECT at atmospheric pressure in the applicator chamber, the point at which pressure begins to increase in the curve of FIG. 1 defines a "balance point" as where ECT=MCT. For higher % wfu values along the curve in FIG. 1, where pressure is required to drive more foam into the fabric, ECT>MCT; also ECT<MCT for % wfu values below that at the "balance point" where non-uniform application occurs. ECT depends primarily on $R_f$ and fabric absorption properties in the particular system involved and, to repeat again, it is a measured quantity for the involved system, not a calculated value.

It has been applicants' experience that those skilled in the art who have seen the figures have not been mislead when the figures are considered in conjunction with the complete specification. FIG. 1 pertains to a specific system operating under the defined parameters. The relationship of ECT and MCT is explained in the specification and in the comments set forth above. At the intercept with the abscissa ECT=MCT for the reasons given; further at other points to the right of this intercept ECT>MCT.

Figure 2:
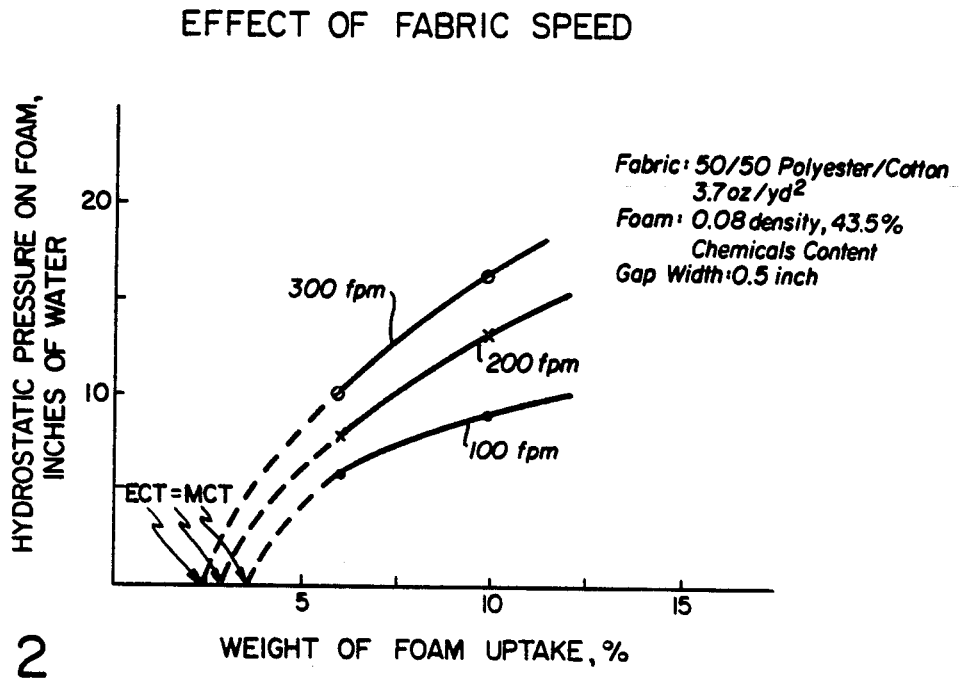
FIG. 2 illustrates, in graphical form, the effect of fabric speed across the nozzle orifice as it relates to hydrostatic pressure on the foam and foam uptake.
Figure 3:
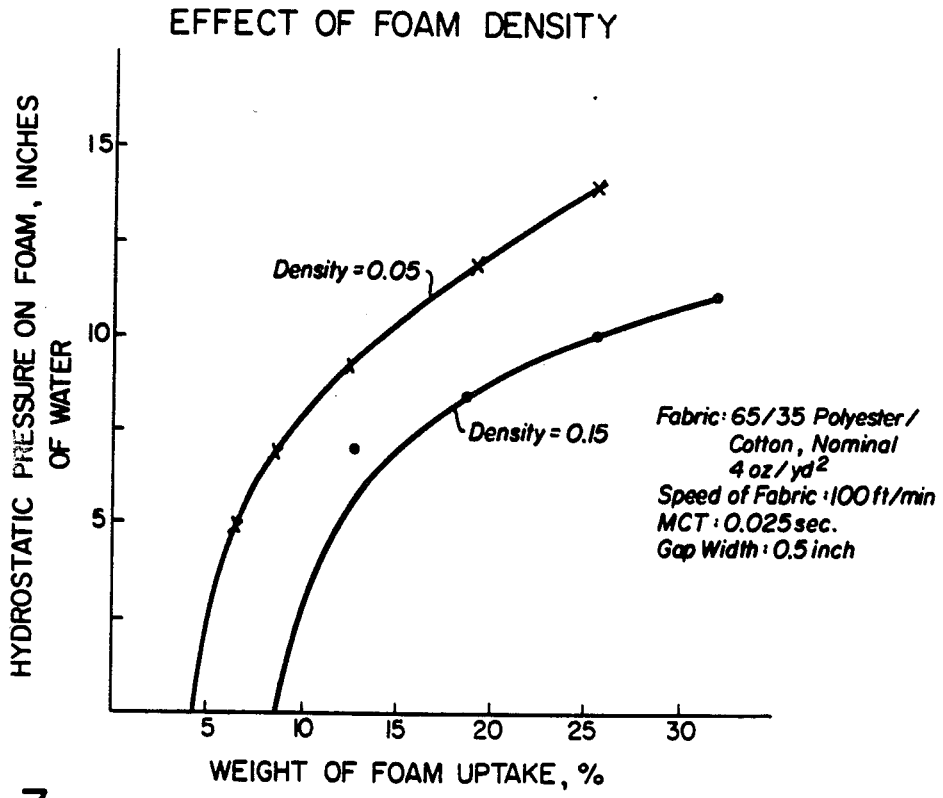
FIG. 3 illustrates, in graphical form, the effect of foam density on the relationship between foam uptake and hydrostatic pressure on the foam.

ECT has not been held constant in FIGS. 1, 2 and 3. ECT is a function of the % wfu, and increases as % wfu increases. Therefore, ECT is increasing along the abscissa in the figures. The operational method of measurement of ECT is to vary the % wfu (hence ECT) until pressure just begins to develop in the application chamber of the nozzle; at this point, the ECT has been made equal to MCT, i.e. ECT=MCT. Thus MCT has been held constant for each curve in the figures but ECT has not.

As discussed above, ECT=MCT at atmospheric pressure, which value is determined by extrapolation back to zero or atmospheric hydrostatic pressure. In determining this value the selected system is operated at different hydrostatic pressures and the weight of foam uptake determined at selected points. These values, hydrostatic pressure and % wfu, are plotted and extrapolated to zero hydrostatic pressure. While only one value of ECT=MCT can be associated with a plotted curve in a graph, the graph also shows the values when ECT is greater than MCT and when ECT is less than MCT, as discussed previously.

The nozzle orifice preferably consists of two lips, edges or surfaces that are spaced apart and are of sufficient length to essentially equal the width of the substrate. The substrate contacts the edges of the two lips, which may be of any selected configuration, e.g. pointed, tapered, flat, beveled, arced, or otherwise, with a pressure sufficient to provide a seal and confine the foam to the zone between the lips. The angular relationship between the substrate as it makes initial contact with a lip and as it exits from a lip, with the application zone, and with the lip surfaces, can be varied over a wide range to assure a seal between the substrate and lips. The extremities of the orifice must be sealed so that the foam does not escape. In some instances when MCT=ECT, it has been possible to operate with only the exiting or downstream lip in contact with the substrate.

A figurative description of an embodiment of the invention is described in FIG. 1, which illustrates the typical relationship that exists between foam uptake by the substrate and hydrostatic pressure on the foam. The curve describes the uptake of foam, measured as total composition including water, by a nominal 4 oz./yd.$^2$, 65/35 polyester/cotton sheeting fabric at a machine contact time (MCT) of 0.025 second. It is surprising and unexpected to find such a large volume of foam being taken up by the fabric at atmospheric pressure within the very short contact time of 0.025 second. The figure shows that foam equivalent to 8 percent of the weight of the substrate, or approximately 35 percent of the unoccupied volume of the fabric, is taken up by the substrate at atmospheric pressure within this short machine contact time. It is also apparent from the slope of the curve that the uptake of foam by the substrate can be increased substantially by the use of low hydrostatic pressures. It has been found that the uptake is relatively independent of fabric speed so long as the nozzle orifice width is adjusted to maintain the same machine contact time. On the other hand, the uptake is affected by fabric and foam characteristics as described elsewhere. At low levels of uptake (below 8 weight percent in FIG. 1) an unsteady condition is encountered which leads to non-uniform application of treating chemicals; i.e., the MCT is greater than ECT. A steady state condition can be achieved when MCT=ECT as illustrated by the intercept of the curve and the abscissa in the figure. Control over uniformity of uptake is achieved with a positive hydrostatic pressure. Therefore, the machine contact time is adjusted to be equal to, or preferably less than the equilibrium contact time of the fabric-foam system. Preferred operating conditions are achieved when the machine contact time causes a hydrostatic pressure on the foam in the nozzle ranging between about 2 in. and 10 in. of water pressure or above. In some instances hydrostatic pressures as high as 100 inches of water have been found beneficial, e.g. treatment of carpets and paper stocks.

Expressing the data plotted in FIG. 1 in tabular form shows the following:

| Weight of Foam Uptake % | Hydrostatic Pressure, in. $H_2O$ | MCT | ECT | Operating Condition |
|---|---|---|---|---|
| 0–8 | 0 | 0.025 | <0.025 | Unstable (Non-uniform) |
| 8 | 0 | 0.025 | 0.025 | Balance Point (ECT = MCT) |
| 13 | 5 | 0.025 | >0.025 | Preferred |

-continued

| Weight of Foam Uptake % | Hydrostatic Pressure, in. $H_2O$ | MCT | ECT | Operating Condition |
|---|---|---|---|---|
| | | | | operation |
| 24 | 10 | 0.025 | >0.025 | Preferred operation |

The values shown in FIG. 1 and this preceding table are those for the system defined in FIG. 1 operating at an MCT of 0.025 second. The data show that ECT=MCT at a weight of foam uptake of 8%. If a different MCT value is used, then the curve will be shifted. This is illustrated in FIG. 2 wherein fabric speeds of 300 fpm (0.0083 second MCT), 200 fpm (0.0125 second MCT) and 100 fpm (0.0250 second MCT) were plotted.

FIGS. 1, 2 and 3 are plots of Weight Of Foam Uptake, % vs Hydrostatic Pressure On Foam, Inches Of Water. They are not plots of ECT. They are plots which enable one to ascertain the relationship between ECT and MCT and to ascertain the point at which ECT=MCT.

FIG. 2 shows the effect of the fabric speed across the nozzle orifice as it relates to hydrostatic pressure and weight of foam uptake. The fabric speed at a given foam uptake affects the ratio of ECT to MCT by its influence on MCT. As the MCT, which is inversely proportional to the fabric speed, is varied the ratio of ECT to MCT varies directly with the fabric speed. In this figure non-uniform application would occur at points left of the intersect of the curve at a particular fabric speed; the area represented by points on the abscissa to the left of the intercept represents that condition when ECT is less than MCT. Uniform application is achieved at points at or to the right of the intersect and along the curve at a particular fabric speed; in these instances ECT is equal to or greater that MCT in the same manner as discussed for FIG. 1. As previously indicated the process is preferably carried out at a positive hydrostatic pressure. The fabric used and the conditions under which the process was carried out are indicated.

In regard to FIG. 2, one must again remember that ECT is a measured value and not a calculated value, and that ECT is measured for each specific system involved. The particular curves in FIG. 2 represent operations on the fabric/foam/gap width system defined and stated which system is employed at three different fabric speeds, 100 fpm (or 0.025 second MCT), 200 fpm (or 0.0125 second MCT) and 300 fpm (or 0.0083 second MCT); it does not represent given values of ECT. The ECT values of the system were determined at the three fabric speeds and plotted to show the effect of fabric speed. It can be seen that as the fabric speed is increased, MCT is decreased, and the % wfu of foam at which pressure begins to develop in the applicator decreases. Application of these principles makes it possible to achieve uniform application to the substrate at exceptionally low % wfu values through appropriate adjustment of the MCT by altering factors which reduces the MCT (e.g., shortening gap width or increasing fabric speed), or by adjusting factors which increase ECT (e.g., decreasing foam wetness or foam density, decreasing foam wetting rate by use of thickeners or weaker wetting agents, or decreasing fabric wetability).

As noted in the prior discussion pertaining to FIG. 1, at atmospheric pressure the foam is being uniformly absorbed by the fabric at the same rate it is being introduced and ECT=MCT at the abscissa intersect point. At higher % wfu values under the same conditions, foam is being delivered at a greater rate than it would be absorbed at atmospheric pressure, but uniform application is still achieved as a result of the driving pressure developed in the applicator head, with ECT>MCT under these elevated pressure conditions along the curve. At points left of the intersection of the curve with the abscissa the amount of foam being delivered to the fabric is less than that which would be absorbed at atmospheric pressure and non-uniform application results and ECT<MCT. In FIG. 2, ECT=MCT at the intersect point of the curves with the abscissa and ECT>MCT at all other points along the curves; therefore, the statement that ECT is equal to or greater than MCT at points along the curves at a particular fabric speed is correct.

FIG. 3 shows the effect of the foam density on ECT. ECT values are defined by the intersection of the pressure curves with the abscissa (Foam Uptake axis). At the points of intersection the ratio of ECT:MCT is 1:1; at any point along the curves above the Foam Uptake axis, the ratio of ECT:MCT is greater than 1. Under these conditions where ECT is equal to or greater than MCT one obtains uniform application of the treating composition to the substrate.

For the same reasons explained above in discussing FIGS. 1 an 2, in FIG. 3, at the intersect points with the abscissa, ECT=MCT; at all other points to the right of the intersect and along the curves of FIG. 3 ECT>MCT.

In FIG. 3, changing the foam density from 0.05 to 0.15 g/cc gives a "wetter" foam, i.e. a foam made up of less air and more liquid. The wetter foam is more rapidly absorbed by the fabric, hence the higher % wfu can be achieved before pressure begins to build up in the applicator. This explains the displacement of the curve for 0.15 g/cc foam toward higher % wfu values, as shown in FIG. 3. At the intersect points of each curve with the abscissa, ECT=MCT, although this has not been labeled in FIG. 3. Those skilled in the art of foam technology know that a foam of higher density produced from the same composition contains more liquid and they consider this a "wetter foam"; they also know that "wetter foams" more rapidly wet the surface of a substrate.

The above figures are based on the conditions indicated; it is apparent to one of ordinary skill in the art that, when operating under conditions where ECT>MCT, as the orifice width or gap width is changed without making any change in the feed rate that there will be a corresponding change on the hydrostatic pressure but that the amount of foam taken up by the fabric will not change. The only change indicated in the previous sentence is in the width of the opening; it is a simple well-known fact to one of normal skill that when operating under conditions where ECT>MCT, and when all other conditions are kept the same, widening of the gap will reduce the pressure in the chamber and narrowing of the gap will increase the pressure in the chamber. Since the amount of feed into the chamber is not changed, the amount exiting will not change as there is no change in the amount exiting, albeit it may have been retained at a different pressure, the amount taken up by the fabric will be the same. This is readily apparent and obvious to one of ordinary skill. Similar curves can be plotted for the conditions prevalent during a particular operation.

In any system, including those portrayed in the Figures, a change in the gap width will alter MCT by definition. However, it will not affect ECT for the specific system involved. Therefore, a change in the orifice width will not change both ECT and MCT; only MCT is changed by a change in the orifice width, and applicants have clearly taught that the gap width can be changed.

The process of this invention permits the application of a single functional treatment, or multiple functional treatments, using a plurality of foaming and application systems, to a substrate followed by subsequent drying or drying and curing of the foam treated substrate prior to take-up. Further, since the amount of foam formulation added on to the substrate is generally below the water retention capacity of the substrate, the substrate can be rolled up without drying and stored or transferred to another location for subsequent use or treatment. The substrate to which the foam is applied may be, but need not be, dry. The ability to apply a desired quantity of a foam formulation independent of the initial state of dryness of the substrate, provided the substrate is not completely saturated, is a unique, unexpected, unobvious, and desirable feature of this process.

The multiple application of two or more treatments or components in succession, using separate functional chemical formulations and applicator nozzles for each, with or without intermediate drying, curing or take-up steps is within the scope of this invention. This multiple application procedure is of particular advantage when the separate treatments or functional reactants are not compatible with each other or are too reactive with one another to be present in a single formulation.

The substrate to which the foamed composition has been applied can be subsequently thermally or radiation treated dependent upon the particular formulation applied and the objective sought. Thus, the treated substrate can be thermally treated to dry or to cure the applied composition or it can be exposed to non-ionizing or ionizing radiation. In any instance any of the known thermal or radiation treatments pertinent to the particular formulation can be employed. Thus, for drying or thermal cure one can use infrared lamps, hot gases, ovens, heated rollers, or similar conventional heating means. For radiation curing one can use ultraviolet radiation, gamma radiation, electron beam radiation, or similar conventional means, whether inerted or not.

The rate of foam formulation uptake by the substrate is influenced by the foam properties, the weight and construction of the substrate, the initial degree of dryness of the substrate and the degree of hydrophilicity of the substrate. Thus, the natural fibers such as wool, cotton or linen are known to be more hydrophilic than are some of the synthetic fibers such as polyester. Hence, these natural fibers can absorb more of the foamed composition and still maintain an essentially dry-to-the-touch feel. It has also been observed that selective pre-wetting or post-wetting of localized areas of the substrate results in migration of the treating foam formulation outward towards the edges of the pre-wetted or post-wetted regions, while the non-wetted regions will dry uniformly without migration. With a dye-containing foamed composition, this technique produces washed-out patterns similar to the effects achieved by tie-dyeing procedures without the need to tie the fabrics.

A particularly unexpected and unobvious finding was that the foam was absorbed by the substrate at a rapid rate and in large volume. In most instances the desired amount of foamed formulation was applied and absorbed within a period of a fraction of a second, generally within less than 0.05 second. Equally unexpected was the discovery that the foam could be applied evenly across the entire substrate or in selected patterns.

In a typical embodiment the equipment used would consist of equipment means to convey the fabric from a let-off roll to the applicator nozzle, a reservoir to prepare and store the textile treating composition, foam generating means for foaming said composition, foam recycle means, means to convey the foam to the applicator nozzle, a foam applicator head and nozzle and take-up means. Optionally one can include treating means to treat or cure the foam treated textile, such as an oven or a radiation generating source. For the purposes of this application the foam applicator nozzle was produced using plexiglass sheet so that visual observation could be maintained. However, any other construction material could be used.

In a typical operation the fabric would be conveyed from a let-off roll across various guide rolls and nip rolls and the foamed treating composition would be applied to one of the surfaces of the fabric as the fabric made contact with the nozzle of the foam applicator head. The fabric was then collected at a take-up roll. As the fabric was conveyed across the foam applicator nozzle, the foamed functional treating composition would come into contact with it and be absorbed by the fabric. The foam entered the chamber via the foam inlet point in the base and exited from the foam applicator head via the applicator nozzle slit whereupon it was deposited on the fabric. The foam was produced by foaming a metered quantity of the textile treating composition in a commercially available foamer and conveying the formed foam to the chamber of the applicator head by suitable conveying means. As the foam entered the chamber via the foam inlet point and filled it, foam velocity diminished before it entered the slit or orifice of the applicator nozzle. It was observed that uniform coating of the foam onto the fabric substrate was achieved when both lips of the applicator nozzle were preferably in contact with the fabric. If the first or upstream lip did not touch the fabric, foam would tend to build up behind the applicator nozzle lip producing a bank of foam and non-uniform application and penetration would often result. When the second or downstream lip of the applicator nozzle did not touch the fabric the curtain of foam would be pulled away from the nozzle slit and areas of the fabric would be skipped, also leading to non-uniform application of the foam composition. In view of these observations it was determined that uniform application of the foam to the fabrics to substrate could best be accomplished when both lips of the applicator nozzle were preferably in contact with the fabric substrate. In some instances it was possible to achieve good application with the fabric in contact solely with the downstream lip, particularly when ECT=MCT.

The following equations are useful in determining the amounts of formulated composition metered into the foamer and the amount of foam applied to the substrate. Equation I indicates the amount of liquid formulated composition metered in cubic feet per minute:

$$V_1 = \frac{(C_s)(v_s)(w_s)(\lambda)}{(c_1)(\rho_1)} \quad \text{I}$$

Equation II indicates the amount of foam applied to the substrate in cubic feet per minute:

$$V_f = \frac{(C_s)(v_s)(w_s)(\lambda)}{(c_1)(\rho_f)} \quad \text{II}$$

The symbols have the following meanings:

$v_s$=substrate linear velocity (line speed), ft/min
$V_1$=liquor volume flow rate, $ft^3$/min
$V_f$=foam volume flow rate, $ft^3$/min
$\rho_f$=density of foam, lb/$ft^3$
$c_1$=concentration (solids) of liquor, % ows
$w_s$=fabric substrate weight, lb/$ft^2$
$c_s$=solids add-on to fabric, % owf
$\lambda$=width across treated substrate or nozzle orifice, ft
$\rho_1$=density of liquid formulated composition, lb/$ft^3$ The equipment used in Examples 1 and 2 consisted of an Oakes Mixer, Model No. 4MHA, connected to a foam applicator head. A metered quantity of the formulation was introduced to the mixer, foamed and conveyed to the applicator via suitable conduits.

The foam applicator head consisted of a chamber and a nozzle. The chamber had a length of about 12 inches, a width of about 1.5 inches and a height of about 1 or 1.5 inches. In the center of the base of the chamber there was located a foam inlet point through which the foamed textile treating composition entered the chamber. Mounted on the top of the chamber was the nozzle that had an elongated slit or orifice running the length of the chamber; the slit could be adjusted in width. In this particular instance it had a height of about 1.5 inches. The lips of the slit tapered outwardly and downwardly at an angle of about 45°. Two foam applicator heads were used differing in the size and shape of the chamber to which the nozzle was affixed. The first applicator head had a chamber volume of 390 cc measuring about 12×1.5×1.5 inches. The second applicator head had a triangular configuration when viewed from the front with a chamber volume of about 84 cc. In this instance the base of the applicator head tapered at an angle from the center where the foam inlet means were located at a depth of one inch to a zero height at the ends of the chamber.

Silicone Surfactant I (Silicone Wetting Agent I) has the formula:

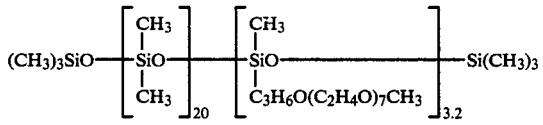

The test procedures used were:

| | | |
|---|---|---|
| Wrinkle recovery | AATCC | 66-1959T |
| Tear strength | ASTM | D-1424-59 |
| Tensile strength | ASTM | D-1862 |
| Wash-wear | AATCC | 124-1967T |
| | Washing Procedure III; Drying Procedure A and B | |
| Yellowness Index | Using a Hunterlab Model D-40 Reflectometer | |

-continued $$\text{Yellowness} = \frac{\text{Green reflectance} - \text{Blue reflectance}}{100}$$

The following examples serve to illustrate the invention.

EXAMPLE 1

A wash-wear formulation was prepared containing the following components:

| | |
|---|---|
| DMDHEU | 2.210 g. |
| Zinc nitrate, 30% | 492 g. |
| Softener I | 246 g. |
| Foaming Agent I | 32.4 g. |
| Wetting Agent I | 12.4 g. |
| Silicone Wetting Agent I | 3 g. |
| Direct Red 37, C.I. 22240 | 3.5 g. |

DMDHEU - 1,3-dimethylol-4,5-dihydroxy-2-imidazolidone, 45% aqueous solution
Softener I - aqueous emulsion of low molecular weight polyethylene, 30% solids
Foaming Agent I - adduct of mixed $C_{11}$–$C_{15}$ linear secondary alcohols with 20 moles of ethylene oxide
Wetting Agent I - adduct of mixed $C_{11}$–$C_{15}$ linear secondary alcohols with 9 moles of ethylene oxide The above textile treating composition was foamed in the commercially available Oakes Mixer. The foam produced was conveyed to the foam applicator heads described above and applied to a cotton fabric passing over the slit of the foam applicator nozzle at a speed of about 25 feet per minute to obtain a chemicals add-on of about 9 weight percent. The width of the slit in the foam applicator nozzle was varied; the details of this series of experiment is set forth in Table A below.

TABLE A

| Applicator Head | | Foam Producing Conditions | | | |
|---|---|---|---|---|---|
| Chamber Size cc | Slit Width in. | Press. psig | Speed RPM | Foam Density gm/cc | Foam Penetration |
| 84 | .015 | 32 | Med | 0.056 | Poor |
| 84 | .035 | 32 | Med | 0.056 | Poor to Fair |
| 390 | .010 | 32 | Med | 0.056 | Excellent |
| 390 | .030 | 32 | Med | 0.056 | Excellent |
| 84 | .015 | 30 | Med | 0.046 | Poor |
| 84 | .035 | 30 | Med | 0.046 | Poor |
| 390 | .010 | 30 | Med | 0.046 | Excellent |
| 390 | .030 | 30 | Med | 0.046 | Excellent |
| 84 | 0.015 | 32 | Max | 0.050 | Poor |
| 84 | 0.015 | 12 | Max | 0.116 | Excellent |

EXAMPLE 2

A wash-wear textile treating composition was prepared similar to that described in Example 1, but omitting the Silicone Wetting Agent. The textile treating composition had a solids content of 39.8 weight percent. It was foamed in a manner similar to that described in Example 1 to produce a foam having a foam density of between 0.05 and 0.06 gram per cc. This foam was applied to mercerized cotton broadcloth in the manner described in Example 1 with the fabric moving at a speed of 25 feet per minute over the nozzle. The nozzle slit was 25 mils wide and the chamber volume was 390 cc. The solids add-on of the foam composition to the fabric was between 6 and 7 weight percent. After the application of the foamed composition to the textile fabric the textile fabric felt dry to the touch. The foam treated fabric samples were stored in a plastic bag until samples were removed for curing. At that time, swatches of the foam treated fabric were cured without an intermediate drying step on pin frames for periods of 10, 30, 60 and 90 seconds at temperatures of 320° and 360° F. In addition, at each temperature one sample was initially separately dried for 90 seconds at 300° F. and then cured for an additional 90 seconds at the indicated curing temperature treatment. Thus, the resulting samples compared a flash curing, that is without an intermediate drying step at various times and temperatures, with a series of samples in which the foam applied finish was initially dried and cured by the conventional procedures. The results achieved are summarized in Table B. From the results it is shown that good wash-wear performance properties are obtained by the process of this invention wherein continuous foam application is used to apply the wash-wear treating formulation to one surface of the fabric. It can also be observed that the intermediate drying step is not necessary to obtain good wash-wear performance properties and that such properties can be obtained in a short curing step at an appropriately high temperature of about 360° F. for about 30 to 60 seconds. The wash-wear properties of the treated fabrics showed excellent durability of the applied reactant as evidenced by the fabric properties measured after 20 home laundering treatments.

TABLE B

| Treatment | | Properties | | | | | | | After 20 Home Launderings | |
|---|---|---|---|---|---|---|---|---|---|---|
| Cure Temperature °F. | Cure Time secs. | Dry Wrinkle Recovery deg. | Wet Wrinkle Recovery deg. | Tear Strength g. | Tensile Strength g. | Wash-Wear Tumble dry | Wash-Wear Spin dry | Yellow-ness index | Dry Wrinkle Recovery deg. | Wash-Wear Tumble Dry |
| 320 | 10 | 166 | 180 | 2112 | 27 | 1.1 | 1.2 | .036 | 182 | 1.0 |
| | 30 | 253 | 183 | 1856 | 21 | 1.5 | 2.8 | .037 | 204 | 2.2 |
| | 60 | 267 | 188 | 1616 | 17 | 2.9 | 2.4 | .036 | 247 | 3.2 |
| | 90 | 265 | 234 | 1520 | 17 | 3.3 | 3.1 | .038 | 251 | 3.4 |
| | Control[x] | 279 | 222 | 1248 | 19 | 3.7 | 3.7 | .039 | 254 | 3.5 |
| 340 | 10 | 190 | 189 | 2160 | 26 | 1.2 | 1.2 | .037 | 183 | 1.2 |
| | 30 | 246 | 211 | 1680 | 19 | 2.8 | 2.4 | .039 | 222 | 3.0 |
| | 60 | 259 | 218 | 1552 | 17 | 3.1 | 2.4 | .042 | 227 | 3.0 |
| | 90 | 286 | 222 | 1376 | 18 | 3.3 | 2.8 | .041 | 253 | 3.4 |
| | Control[x] | 278 | 225 | 1520 | 18 | 3.2 | 2.6 | .044 | 244 | 3.2 |
| 360 | 10 | 227 | 178 | 2112 | 23 | 2.0 | 1.6 | .036 | 176 | 1.3 |
| | 30 | 279 | 240 | 1520 | 20 | 3.0 | 1.8 | .040 | 208 | 2.3 |
| | 60 | 286 | 247 | 1200 | 15 | 3.5 | 3.1 | .045 | 261 | 3.5 |
| | 90 | 288 | 247 | 1232 | 14 | 3.6 | 3.3 | .043 | 261 | 3.5 |
| | Control[x] | 274 | 253 | 1264 | 15 | 3.4 | 2.9 | .042 | 273 | 3.4 |

[x]Control indicates samples were dried 1.5 minutes at 300° F. and cured at indicated cure temperature for 1.5 minutes to typify conventional curing conditions. All samples other than these marked control were not thermally dried.

EXAMPLE 3

A wash-wear formulation was prepared containing the following components, in weight percentages:

| | |
|---|---|
| DMDHEU | 80.4% |
| Zinc nitrate, 30% | 17.9% |
| Foaming Agent I | 1.2% |
| Wetting Agent I | 0.4% |
| Silicone Wetting Agent I | 0.1 |

The liquid formulation included a trace amount of a commercial tracer dye, it had a density of 1.18 g/cc and a total solids of 43.5 weight percent. It was foamed in a commercially available Ease-E-Foamer Model No. E1000 at a ratio of 16 volumes of air per volume of liquid and the thick foam produced had a density of 0.073 g/cc. Foam was produced at a feeding rate of 564 cc/min. of the liquid formulation to the foamer. The pressure on the foamer head was 20 psig. The foam was delivered to an applicator nozzle and uniformly applied to one surface of a 50/50 polyester/cotton sheeting about 9 inches wide that weighed about 4 ounces per square yard. The fabric was travelling over the applicator nozzle at a speed of 300 feet per minute for an MCT of 0.0011 second. Under these application conditions the pressure drop of the foam at the nozzle was 16.5 inches of water pressure drop across the fabric with an eight percent chemicals add-on of the formulation to the fabric.

The equipment used in the process consisted of suitable feed, take-up and guide rolls for the fabric; the foamer and means for delivering the foam to the applicator head; and the applicator head. The applicator head comprised a chamber having a foam inlet point centrally located in the base and the applicator nozzle mounted on the top. The internal chamber dimensions of the applicator head were about 9.5 inches long by about 1.75 inches wide by about 2 inches high, representing a total volume of about 33 cubic inches. The applicator nozzle consisted of a two-piece slotted head forming a slot extending along the length of the chamber. The head, attached to the chamber body, had a taper of 45° for each piece exiting from the chamber, a slot width of 0.064 inch, a slot height of 1.5 inches, and the exterior lips also had a taper of 45°. The foam entered the chamber through the inlet point in the base, filled the chamber at a positive pressure, exited from the chamber through the slot of the applicator nozzle and contacted the fabric and was absorbed by it at the applicator nozzle lips. The fabric moved across and contacted both exterior lips of the applicator nozzle at the indicated speed of 300 feet per minute. Uniform application on the fabric was observed.

EXAMPLE 4

A wash-wear formulation was prepared containing the following components, in weight percentages, and a tracer dye:

| | |
|---|---|
| DMDHEU | 76.0% |
| Zinc Nitrate, 30% | 15.1% |
| Softener I | 7.6% |
| Wetting Agent I | 0.3% |
| Foaming Agent I | 0.9% |

-continued

| | |
|---|---|
| Silicone Wetting Agent I | 0.1% |

The liquid formulation had a density of 1.18 g/cc and a total solids content of 43.5 weight percent and also contained a tracer dye. It was foamed using the same equipment described in the immediately preceding example at a ratio of 25 volumes of air per volume of liquid formulation; the foam produced had a density of 0.048 g/cc. The pressure on the foamer head and lines to the applicator head was 18 psig. The foamed formulation was applied to one surface of a 65/35 polyester/cotton sheeting fabric that was 48 inches wide and weighed about 4 ounces per square yard using modified commercially available tenter frame and feeder means to convey the fabric across the foam applicator nozzle and subsequently cure the formulation. Fabric speed was maintained at 30 feet per minute for an MCT of 0.011 second. To insure proper cure in the pilot scale pin tenter dryer, a limitation on the speed was imposed by the equipment. Contact time in the tenter frame dryer was 42 seconds at 360° F. Tension on the fabric was maintained by nip roll and idler roll means. Improved results were noted in this experiment when idler rolls were located on each side of the applicator nozzle slot about 6 inches below the top of the applicator nozzle lips and about 12 inches from the center of the nozzle orifice. The add-on of foamed chemical formulation was eight percent.

The apparatus used was a larger version similar to that described in Example 3 and contained a distribution plate in the internal chamber. The inside chamber dimensions were 60 inches long by 2.25 inches wide by 7 inches high at the foam inlet end and 5 inches high at the opposite end. The distribution plate was located across the entire width and length of the chamber, at a point 4 inches from the top of the chamber. This distribution plate had 61 openings, each 0.07 inch in diameter, uniformly located thoughout its surface and divided the applicator head into a lower distribution chamber and an upper application chamber. The foam entered the distribution chamber at the end having the greatest height, passed through the openings in the distribution plate into the application chamber to give a uniform rise of the foam into the application chamber and then through the applicator nozzle to the fabric surface. The slot in the applicator nozzle was 0.032 inch wide and 2 inches high. Under the conditions stated, the pressure drop of the foam across the distribution plate was 4 inches of water pressure. It was observed that a uniform application of the foamed formulation was obtained.

EXAMPLE 5

A formulation was prepared containing the following components in weight percentages:

| | |
|---|---|
| DMDHEU | 80.4% |
| Zinc Nitrate, 30% | 17.9% |
| Foaming Agent I | 1.2% |
| Wetting Agent I | 0.4% |
| Silicone Wetting Agent I | 0.1% |

The liquid formulation included a tracer dye, it had a density of 1.18 g/cc and a total solids of 43.5 weight percent. This formulation was foamed by several different procedures using different commercially available foam producing equipment. An Oakes mixer, Model 4MHA, was used running the rotor at 1,740 rpm and a pressure of 30 psig and then at 740 rpm and a pressure of 16 psig to produce foams having a density of 0.09 g/cc. The liquid formulation was fed at the rate of 564 cc/minute and the ratio of air to liquid was about 13:1 by volume. It was observed that the bubbles produced when the foamer was operated at 740 rpm were larger than those when operated at 1,740 rpm. The second commercially available foamer used was the Ease-E-Foamer, Model M 1000, operated at 410 rpm and a pressure of 20 psig; this produced a foam having a density of 0.092 g/cc. The foam bubbles produced in this instance were slightly larger than those produced using the Oakes Mixer. The foams were applied to one surface of a 65/35 polyester/cotton sheeting fabric by the procedure described in Example 3 using the same application equipment therein described. The nozzle slit width was one inch. The fabric was travelling over the applicator nozzle at a speed of 300 feet per minute for an MCT of 0.0167 second. Application uniformity was superior with the bubbles produced using the Ease-E-Foamer and the bubbles produced using the Oakes Mixer operated at 740 rpm. Some non-uniformity was observed on application of the bubbles produced with the Oakes Mixer operated at 1,740 rpm; this non-uniformity was attributed to the smaller bubble size obtained.

EXAMPLE 6

A formulation was prepared containing the following components in weight percentages:

| | |
|---|---|
| DMDHEU | 81.2% |
| Zinc Nitrate, 30% | 17.9% |
| Wetting Agent II | 0.6% |
| Foaming Agent I | 0.3% |

Wetting Agent II—adduct of mixed $C_{11}$ to $C_{15}$ linear secondary alcohols with 7 moles of ethylene oxide.

The liquid formulation had a density of 1.18 g/cc. and a total solids of 43.5 weight percent. It was foamed using a commercially available Ease-E-Foamer operating at 410 rpm at ratios of 10, 13 and 20 volumes of air per volume of liquid. The foams produced had the densities indicated in Table III. The foam was delivered to an applicator nozzle and uniformly applied to the surfaces of three different fabrics, a 65/35 polyester/cotton (Fabric A), a 50/50 polyester/cotton (Fabric B) and a 100 percent cotton (Fabric C) at an add-on of 6 weight percent. In this series the rate at which the fabric was travelling was varied at 100, 200 and 300 feet per minute over the applicator nozzle to determine the balance point between ECT and MCT at wide orifice openings. In addition, the width of the slit of the applicator nozzle was varied at 1 inch, 3 inches and 4 inches using modified applicator heads. At these applicator nozzle slit widths, it was found that good application was obtained under these specific conditions. It was also observed that the foam begins to roll in the applicator nozzle and develops a rolling bank at high speeds and wide nozzle openings, as well as a change in the foam structure.

The applicator heads used in this example were constructed so that the width of the applicator nozzle could be varied over a wide range. The basic structure was similar to that described in Example 4 in that it consisted of a distribution chamber and an application chamber separated by the distribution plate at a height of one inch above the base. Applicator Head A had a distribution chamber measuring 9 inches long by 1inch in height by 3 inches in width and an application chamber measuring 9 inches long by 3 inches in height with the width adjustable from 0.25 to 3 inches. The distribution plate had 17 holes each $\frac{3}{8}$ inch in diameter. In Application Head B the distribution chamber was 6 inches wide and the application chamber could be adjusted up to six inches in width; this head had the same number and size of holes. The nozzle width was equal to the selected adjusted width of the application chamber and selection was made by adjusting the location of one of the lips, the two lips forming two sides of the application chamber. Applicator Head B was used when the nozzle width was greater than 3 inches. During application of the foamed formulation to the fabric, the fabric was in contact with both lips of the applicator nozzle. The conditions under which the fabrics were treated are summarized in the following table wherein the nozzle slit width and water pressure are reported:

TABLE III

| | Nozzle Slit Width Inches and (Water Pressure Inches) | | | |
|---|---|---|---|---|
| Fabric | At 100 fpm | At 200 fpm | At 300 fpm | Density g/cc |
| A | $\frac{1}{4}$(−) | $\frac{1}{4}$($\frac{1}{4}$) | 3($\frac{1}{4}$) | 0.12 |
| B | $\frac{1}{4}$($\frac{3}{4}$) | $\frac{1}{2}$(1) | 3($\frac{5}{8}$) | 0.12 |
| C | $\frac{1}{2}$(2) | $\frac{1}{4}$(1) | 3(1$\frac{1}{2}$) | 0.12 |
| A | $\frac{1}{4}$(1) | $\frac{1}{4}$(2$\frac{1}{4}$) | 3$\frac{1}{4}$(1$\frac{1}{2}$) | 0.09 |
| B | $\frac{1}{2}$(3/2) | $\frac{1}{2}$(1$\frac{1}{2}$) | 3$\frac{1}{4}$(13/8) | 0.09 |
| C | $\frac{3}{4}$(2) | $\frac{3}{4}$(15/8) | 3$\frac{1}{4}$(1$\frac{3}{4}$) | 0.09 |
| A | $\frac{1}{2}$(1$\frac{1}{2}$) | 1$\frac{1}{2}$(1$\frac{1}{2}$) | 4($\frac{5}{8}$) | 0.06 |
| B | $\frac{3}{4}$($\frac{5}{8}$) | 1$\frac{1}{2}$(1$\frac{1}{4}$) | 4(1) | 0.06 |
| C | 1(2) | 1$\frac{1}{2}$(1$\frac{1}{2}$) | 4($\frac{1}{4}$) | 0.06 |

EXAMPLE 7

A wash-wear formulation was prepared containing the following components in weight percentages:

| | |
|---|---|
| DMDHEU | 81.2% |
| Zinc Nitrate, 30% | 17.9% |
| Wetting Agent II | 0.6% |
| Wetting Agent I | 0.3% |

The liquid formulation had a density of 1.18 g/cc. and a total solids of 43.5 weight percent. It was foamed in a commercially available Ease-E-Foamer, at a ratio of 13 and 6 volumes of air per volume of liquid with the foamer operated at 410 rpm. The combination of wetting agents served the dual function of foaming agent and wetting agent. Satisfactory foam was produced having a half-life of about 15 minutes and densities of 0.089 g/cc. and 0.2 g/cc., respectively. The foam was applied using an applicator head 9 inches long by 2.5 inches in height. The two sides were spaced one inch apart and the tops tapered at an angle of 45°. The space between the sides comprised the nozzle orifice or gap. Foam was introduced into the nozzle applicator through the base and fabric was moved across the nozzle at a speed of 100 feet per minute for an MCT of 0.011 second. Excellent uniformity of application was observed.

EXAMPLE 8

A formulation was prepared containing the following components in weight percentages:

| | |
|---|---|
| DMDHEU | 81.2% |

-continued

| | |
|---|---|
| Zinc Nitrate, 30% | 17.9% |
| Wetting Agent II | 1.2% |

Attempts to produce a foam by the procedure followed in the immediately preceding example resulted in a foam that had a density of 0.48 g/cc. The high density of this foam made it unsatisfactory and it could not be uniformly applied by the process of this invention. In this example Wetting Agent II by itself was shown not to be an adequate foaming agent.

EXAMPLE 9

Two formulations were prepared as follows:

| | A | B |
|---|---|---|
| DMDHEU | 81.2 | 81.2 |
| Zinc Nitrate, 30% | 17.9 | 17.9 |
| Foaming Agent I | 0.3 | 0.6 |
| Half-life, Minutes | — | 26 |

These formulations were foamed in the manner similar to that described in Example 7. Formulation A does not produce a satisfactory foam since the density was 0.41 g/cc. Formulation B produced a satisfactory foam having a bubble size of 0.243 mm and a density of 0.04 g/cc. when the foamer was operated at 210 rpm. Using the procedure and application head described in Example 7, the foam from formulation B was applied at 50/50 polyester/cotton sheeting fabric at a 9 percent add-on at a speed of 300 feet per minute. Uniform application was achieved on the polyester/cotton. When the foamer was operated at 485 rpm, the foam produced, though it had the same density, had a bubble size of 0.043 mm., and it would not apply uniformly.

EXAMPLE 10

Two formulations were prepared containing the following components:

| | A | B |
|---|---|---|
| DMDEHU | 81.2 | 81.2 |
| Zinc Nitrate, 30% | 17.9 | 17.9 |
| Foaming Agent I | 1.2 | 1.2 |
| Silicone Surfactant I | 0.1 | — |

These formulations were foamed in the manner similar to that described in Example 7. In both instances satisfactory foam was produced having a density of 0.09 g/cc. The formulation containing Silicone Surfactant I produced foam that had a foam half-life of 14 minutes, while the foam half-life of the formulation that did not contain the silicone was 10 minutes.

EXAMPLE 11

Two formulations were prepared containing the following:

| | A | B |
|---|---|---|
| DMDHEU | 81.2 | 81.2 |
| Zinc Nitrate, 30% | 17.9 | 17.9 |
| Wetting Agent II | 0.6 | 0.6 |
| Foaming Agent II | 0.3 | 0.3 |
| Zonyl FSN (Perfluoro- | 0.5 | |

-continued

| | A | B |
|---|---|---|
| alkyl Surfactant) | | |

Foaming Agent II—adduct of mixed $C_n$–$C_{15}$ linear secondary alcohols with 12 moles of ethylene oxide.

Foams were produced by the procedure similar to that described in Example 7. The foam produced with formulation A had a density of 0.09 g/cc. and a half-life of 5.5 minutes. The foam produced with formulation B had a density of 0.9 g/cc. and had a half-life of 21 minutes. Application of the two foams produced on 50/50 polyester/cotton and 100 percent cotton sheeting fabric resulted in good uniform distribution of the composition. The foamed formulation was applied using the procedure and equipment described in Example 7.

EXAMPLE 12

A series of formulations were prepared differing in the amount of thickener added. The constant components in the formulations were as follows:

| | |
|---|---|
| DMDHEU | 81.2 |
| Zinc Nitrate, 30% | 17.9 |
| Wetting Agent II | 0.6 |
| Foaming Agent I | 0.3 |

Formulation A did not contain any thickener and had a Brookfield viscosity of 5.2 cps at 23° C. Formulation B contained 0.1 percent hydroxyethyl cellulose, which in a one percent solution had an LVT Brookfield viscosity of about 3,000 cps at 25° C. using a No. 3 spindle at 30 rpm; the formulation had a Brookfield viscosity of 15.7 cps at 23° C. Formulation C contained 0.2 percent of the same hydroxyethyl cellulose and had a Brookfield viscosity of 30.4 cps at 23° C. Formulation D contained 0.3 percent of the same hydroxyethyl cellulose and had a Brookfield viscosity of 83.1 cps at 23° C. These formulations were foamed as described in Example 7 to produce foams having a density of 0.045 g/cc. and the foams were applied to 4 ounce 65/35 polyester/cotton and 100 percent cotton sheeting fabrics. The applicator head used had a distribution chamber measuring 9 by 2 by 2 inches and an application chamber measuring 9 by 2 by 0.75 inches. The applicator nozzle slit was therefor 0.75 inch wide. The distribution plate had 15 holes, each 3/16 inch in diameter. The inward taper on the exit lip of the nozzle was 5°. The add-on at a fabric speed of 300 feet per minute was six weight percent. The uniformity of application was good for formulations A to C inclusive and fair for formulation D.

EXAMPLE 13

A formulation was prepared containing the following components:

| | |
|---|---|
| DMDHEU | 81.2 |
| Zinc Nitrate, 30% | 17.9 |
| Wetting Agent II | 0.6 |
| Foaming Agent I | 0.3 |

The liquid formulation had a density of 1.18 and a total solids content of 43.5 percent. It was foamed in an Ease-E-Foamer by feeding 188 cc per minute of the formulation into the foamer with sufficient air to produce a foam that had a density of 0.02 g/cc while operating the foamer at 410 rpm. The foam was applied to the surface of a 50/50 polyester/cotton sheeting fabric at an add-on of 3 percent using the apparatus described in Example 12 at an applicator nozzle width opening of 1 3/16 inches at a 5° taper on the exit lip. Application to the fabric was at a fabric speed of 300 feet per minute and a pressure drop of 0.25 inch water pressure across the fabric. Good uniform application was achieved.

EXAMPLE 14

The effect of pre-wetting the fabric with 60 percent water when using the process of this invention was evaluated in this example. A formulation was prepared containing the following components:

| | |
|---|---|
| DMDHEU | 80.9 |
| Zinc Nitrate, 30% | 17.9 |
| Wetting Agent II | 0.6 |
| Foaming Agent II | 0.6 |

This formulation was foamed using the Ease-E-Foamer operating at 410 rpm and a feed of 125 cc per minute. The foam produced had a foam density of 0.06 g/cc. This was applied to the pre-wet cotton sheeting using the apparatus described in Example 12 and an applicator nozzle width opening of 0.5 inch at a fabric speed of 300 feet per minute. Uniform application of the formula was achieved on the pre-wet fabric and the pressure drop across the fabric was 0.5 inch of water pressure. When the same foam was applied to the same fabric that had not been pre-wet, the pressure drop across the fabric was $2\frac{5}{8}$ inches of water pressure.

EXAMPLE 15

A formulation was prepared containing the following components:

| | |
|---|---|
| DMDHEU | 81.2 |
| Zinc Nitrate, 30% | 17.9 |
| Wetting Agent II | 0.6 |
| Foaming Agent I | 0.3 |

This formulation was foamed in an Ease-E-Foamer with the rotor operating at 410 rpm using a formulation feed of 564 cc per minute and a ratio of 15 volumes of air per volume of formulation. The foam produced had a density of 0.078 g/cc. This foam was applied to 8 ounces per square yard, 50/50 polyester/cotton fabric sheeting at a fabric speed of 300 feet per minute at an add-on rate of 4.5 percent under the same conditions described in Example 13 using a nozzle that had a slot width opening of 1 3/16 inches. Excellent uniformity was observed. The pressure drop across the fabric was $2\frac{7}{8}$ inches of water.

EXAMPLE 16

A dye formulation was prepared containing the following:

| | |
|---|---|
| Latyl Orange 2 GFS (C.I 44) | 6.8 lb |
| Water | 36.4 lb |
| Wetting Agent II | 0.4 lb |
| Foaming Agent II | 0.4 lb |

The pH was adjusted to 5–6 with acetic acid and foams were produced using the Ease-E-Foamer with the rotor operating at 340 rpm having different foam densities:

| Foam | A | B |
|---|---|---|
| Density, g/cc | 0.03 | 0.057 |
| Half-life, min | — | 5 |
| Liquid feed to foamer, c/c min | 125 | 125 |

The foams were applied to 100 percent polyester and to 65/35 polyester/cotton sheeting fabric using the applicator head described in Example 12 with the nozzle orifice adjusted to a gap width between the lips of 0.5 inch. The fabric was moving at a speed of 100 feet per minute across the orifice, contacting both lips of the nozzle, total wet add-on was 14 weight percent.

When applying Foam A to the 100 percent polyester, sections of the nozzle opening were blocked with tape and a striped pattern was obtained on the fabric. The foam, as in the other examples, was uniformly applied to the fabric, leaving the fabric essentially dry to the touch. After standing for a period of time, the striped fabric was heated at 420° F. lfor 3 minutes to fix the dye. Clear definition of the pattern was obtained. In a similar manner, the entire fabric surface was dyed by removing the tape from the nozzle.

Foam A was used to apply a pattern to 65/35 polyester/cotton with the same equipment. A pattern effect was attained by positioning a stencil between the nozzle and fabric, the stencil moving at the same rate as the fabric, as the foam exited from the nozzle. The dyed areas of the fabric were uniform and even and clear definition of the dyed areas was noted.

Foam B was applied to 100 percent polyester in the same manner to completely dye the fabric. Uniform application and even dyeing were observed. A section of the fabric was sprinkled with water after the foam was applied, the fabric taken up on a roll, stored about 48 hours, and the dye was then fixed at about 420° F. for 3 minutes, a random pattern was observed showing lighter areas were the water droplets were deposited.

In all instances a scour after dye fixation is recommended.

EXAMPLE 17

A combination wash-wear and dye formulation was prepared containing the following:

| | |
|---|---|
| DMDHEU | 24,270 g |
| Zinc Nitrate, 30% | 5,370 g |
| Wetting Agent II | 180 g |
| Foaming Agent II | 180 g |
| Latyl Orange 2 GFS | 3,540 g |

A portion of the above formulation was diluted with 25 percent water, the pH adjusted to 5–6 and a foam was produced as described in Example 16, having a density of 0.046 g/cc and a foam half-life of about 9.4 minutes, by feeding 376 c/min of the formulation to the foamer and using an air to liquid ratio of about 25:1. The foam was applied to 65/35 polyester/cotton fabric using the equipment and orifice opending described in Example 16. The fabric was moving at a speed of 300 feet per minute, for an MCT of 0.008 second. The add-on to the fabric was 4.5 weight percent of DMDHEU and 1.5 weight percent of dye. When the fabric was entirely dyed, uniform application and even dyeing were noted. The foam-treated fabric was subsequently cured at 420° F. for 3 minutes. The same foam was used to print a pattern on the cloth by the procedure described in Example 16. Clear definition was obtained. The data illustrates that one can apply several treatments, in this case both wash-wear and dyeing, simultaneously and without intermediate drying steps. Scouring after dye fixation is recommended to improve crocking and wet fastness properties, and remove any loose dye from the fabric.

EXAMPLE 18

A dye formulation was prepared containing the following:

| | |
|---|---|
| Latyl Orange 2 GFS | 5.6 lb. |
| Water | 36.4 lb. |
| Wetting Agent II | 2.1 lb. |
| Foaming Agent II | 0.4 lb. |
| Silicone Surfactant I | 0.04 lb. |
| Hydroxyethyl Cellulose* | 0.04 lb. |

*Same as described in Example 12.

The pH of the formulation was adjusted to 5–6 with acetic acid and foam was produced using the Ease-E-Foamer as in Example 17. The foam had a density of 0.075 g/cc. It was applied to 65/35 polyester/cotton using the same procedures and equipment used in Example 17 for an add-on of 1.5 weight percent dye. Application uniformity was excellent and an evenly dyed fabric was obtained, both before and after dye fixation, by heating at 420° F. for 3 minutes.

A portion of the dye formulation was diluted with five times its weight of water. This was padded onto the fabric and dye migration evaluated by AATCC Test Method 140-1974. For comparative purposes a swatch of the foam treated fabric, taken immediately after the foamed dye formulation had been applied to it, was also evaluated for dye migration. It was observed that the fabric treated with the concentrated dye formulation by the foam process of this invention showed essentially no dye migration, whereas the fabric treated with the diluted and padded formulation showed excessive and pronounced dye migration. The values obtained from the test procedure were 4% and 48.8%, respectively.

What is claimed is:

1. In a method of treating a porous substrate by the application to at least one surface thereof of at least one functional treating composition, the steps of:

(a) foaming said functional treating composition to produce a semi-stable foam having a foam density from 0.005 to 0.6 gram per cc, an average bubble size of from 0.05 to 0.5 millimeters in diameter, and a foam half life of 1 to 60 minutes;

(b) continuously conveying the foamed functional treating composition to an applicator nozzle;

(c) continuously conveying the substrate across and in contact with said applicator nozzle so as to simultaneously contact said substrate with said foamed functional treating composition and said applicator nozzle at a rate such that uniform application of said functional treating composition on said substrate is achieved;

(d) depositing a predetermined, controlled amount of said foamed functional treating composition on the surface of said substrate at said applicator nozzle, wheron said foam immediately breaks contact and is readily absorbed thereby to leave the surface of said substrate essentially dry to the touch; and (e) recovering the treated substrate; wherein the functional treating composition comprises from 5 to 75 weight percent of functional chemical, from 0.2 to 5 weight percent of foaming agent, from 0 to 5 weight percent of wetting agent, and water making up the balance thereof.

2. A method as claimed in claim 1, wherein the foam density is from 0.005 to 0.3 gram per cc.

3. A method as claimed in claim 1, wherein the foam density is from 0.01 to 0.2 gram per cc.

4. A method as claimed in claim 1, wherein foamed functional treating composition is applied to one surface of the substrate.

5. A method as claimed in claim 1, wherein foamed functional treating composition is applied to both surfaces of the substrate.

6. A method as claimed in claim 1, wherein a multiplicity of foamed functional treating compositions are successively applied to the substrate.

* * * * *

UNITED STATES PATENT AND TRADEMARK OFFICE

CERTIFICATE OF CORRECTION

PATENT NO. : 4,562,097

DATED : December 31, 1985

INVENTOR(S) : Walter et al.

It is certified that error appears in the above-identified patent and that said Letters Patent is hereby corrected as shown below:

At column 23, line 2 "linch" should read -- 1 inch --.

At column 27, line 62 "opending" should read -- opening --.

In Claim 1 at line 21, found in column 28 at line 68: "wheron" should read -- whereon --; and after "breaks" insert -- on --.

Signed and Sealed this

*Fifteenth* Day of *April 1986*

[SEAL]

*Attest:*

DONALD J. QUIGG

*Attesting Officer*

*Commissioner of Patents and Trademarks*